US005915936A

United States Patent [19]

Brentzel

[11] Patent Number: 5,915,936

[45] Date of Patent: Jun. 29, 1999

[54] FIREARM WITH IDENTIFICATION SAFETY SYSTEM

[76] Inventor: John Charles Brentzel, 65 Prescott Rd., Boxborough, Mass. 01719

[21] Appl. No.: 08/980,710

[22] Filed: Dec. 1, 1997

[51] Int. Cl.[6] ..... F41A 17/00

[52] U.S. Cl. ..... 42/70.11; 42/70.11

[58] Field of Search ..... 42/70.11

[56] References Cited

U.S. PATENT DOCUMENTS

| | | | |
|---|---|---|---|
| 4,467,545 | 8/1984 | Shaw, Jr. | 42/70.11 |
| 5,461,812 | 10/1995 | Bennett . | |
| 5,502,915 | 4/1996 | Mendelsohn et al. . | |
| 5,603,179 | 2/1997 | Adams . | |
| 5,603,180 | 2/1997 | Houze . | |
| 5,704,153 | 1/1998 | Kaminski et al. | 42/70.11 |

*Primary Examiner*—Charles T. Jordan
*Assistant Examiner*—Denise J. Buckley
*Attorney, Agent, or Firm*—Michael I. Kroll

[57] ABSTRACT

A firearm with an identification safety system for preventing use by an unauthorized user. The firearm includes a barrel for discharging the firearm therethrough, a butt section connected to the barrel, a trigger connected between the barrel and butt section for initiating discharge of the firearm and a safety switch operable between a first position preventing discharge of the firearm and a second position allowing discharge of the firearm. A pressure sensor is positioned in the butt section for sensing grasping of the butt section by a palm of a user and a scanning sensor is connected for scanning a palm print of the palm of the user and generating a data signal representative of the scanned palm print upon sensing grasping of the butt section by the pressure sensor. A memory unit stores data signals representative of palm prints of authorized users and a microprocessor is connected to both the scanning sensor and the memory unit for receiving the data signal from the scanning sensor and comparing the received data signal to the data signals stored in the memory unit. The microprocessor controls the safety switch to operate in the first position upon determining the received data signal does not match any of the data signals stored in the memory unit and controls the safety switch to operate in the second position upon determining the received data signal matches one of the data signals stored in the memory unit.

7 Claims, 7 Drawing Sheets

FIREARM WITH IDENTIFICATION SAFETY SYSTEM

BACKGROUND OF THE INVENTION

1. Field of the Invention

The present invention relates to firearms and, more particularly, the present invention relates to a firearm able to identify the user and prevent activation when retained by an unauthorized user.

2. Description of the Prior Art

Numerous innovations for firearm identification systems have been provided in the prior art. For example, U.S. Pat. Nos. 5,461,812; 5,502,915; 5,603,179; and 5,603,180 are all also illustrative of such prior art. While these units may be suitable for the particular purpose to which they address, they would not be as suitable for the purposes of the present invention as heretofore described.

This invention teaches a novel method of safeguarding and protecting a weapon from being accidentally fired of misused by an unauthorized person. Without a verified pre-registration signal, an arming safety solenoid remains in a fail-safe position, preventing use of the weapon. The electronically actuated solenoid enables the use of trigger only when a valid identification signal is received. The system is comprised of micro-miniature circuits contained within the grip of the weapon and a ring that is worn on same hand that uses the firearm.

When the weapon is first picked up by the intended user, a switch closure in the grip of the gun turns on a transmitter, which sends a low power, limited range interrogation signal to the finger ring. Upon receipt of this signal, a transponder mounted within the finger ring responds by sending a coded signal that contains a serial number identification. A microprocessor contained within the weapon then compares this decoded signal with one pre-registered serial number stored in memory and if the comparison is valid, actuates the arming safety solenoid, allowing the gun to be fired.

Arming the weapon for firing can only be accomplished upon receipt of a verifiable identification signal from the finger ring; the finger ring must be worn by user and be within the range of the electromagnetic transceivers and must be within the range of the magnetic metal sensors.

A programmable gun has a body supporting a handle, a trigger and a pin actuatable between a first position providing for a trigger depression to fire a bullet and a second position restraining the trigger depression. A memory stores a print identifying an authorized person's hand when such person inserts a key in the handle and then grips the handle. Hand prints of one (1) or more authorized persons, or several hand prints of one (1) person, may be stored in the memory when such persons move the key, after insertion, to individual positions and then grip the handle. When an authorized person thereafter grips the handle, that person's hand generates a print for comparison with the prints in the memory. A comparison coincidence produces a pin actuation to the first position. A subsequent gun firing is recorded in the memory as to time and as to the authorized person. When a comparison coincidence is established, the ability to fire the gun continues until such authorized person relinquishes the gun. If the authorized person relinquishes the gun before firing, the pin becomes actuated to the second position after a particular time period. If the authorized person again grips the handle during such particular time period, the time period is reinitiated. When an unauthorized person grips the handle, no comparison coincidence occurs and the pin is not actuated to the first position. A print of such unauthorized person's hand and the recording time are recorded in the memory.

A safety mechanism for a firearm consisting of a specialized scanning mechanism built into the firearm's trigger. The scanner is programmed to read the unique fingerprints of a given individual. The device is also capable of holding the programmed print information for more than one person, so that multiple people would be able to use the firearm. However, usage is limited to only those persons whose hand prints have been pre-stored in the scanner. The scanner mechanism is connected to the firearm's safety lock. The safety is prevented from being released without proper authorization from the scanner. When a person grips the weapon and places his finger on the trigger, the pressure of the finger on the trigger activates the scanner, and the scanner reads the fingerprint to determine if the scanned fingerprint matches one of the pre-stored fingerprint images. If the individual is an authorized user, the scanner transmits a signal to the safety, releasing this device and activating the firearm for use.

A safety system for a hand gun includes an electrode exposed through the handle. A high voltage source inside the handle connects to the electrode through a switch controlled by a receiver activated by a transmitter carried by an authorized person. If the authorized person loses possession of the hand gun, the transmitter is actuated thereby energizing the electrodes. If an unauthorized person is holding the hand gun within range of the transmitter, a high voltage shock is delivered through the electrodes. The unauthorized person thereupon drops the hand gun and it is no longer a threat to the authorized person.

SUMMARY OF THE INVENTION

The present invention relates to firearms and, more particularly, to a firearm able to identify the user and prevent activation when retained by an unauthorized user.

A primary object of the present invention is to provide a firearm with an identification safety system which will overcome the shortcomings of the prior art.

A further object of the present invention is to provide a firearm with an identification safety system which is able to identify authorized users of the firearm.

A still further object of the present invention is to provide firearm with an identification safety system which prevents use of the firearm by an unauthorized user.

An even further object of the present invention is to provide a firearm with an identification safety system including a pressure sensor for determining when the firearm is handled and initiate an identification process upon determining the firearm is being handled.

A yet further object of the present invention is to provide a firearm with an identification safety system including a plurality of scanners for scanning the palm of a user handling the firearm for comparison against a database of previously scanned palm prints to determine if the user is authorized.

A still further object of the present invention is to provide a firearm with an identification safety system which is able to record the time, date and user whenever the weapon is used for retrieval at a later time and used for ballistic purposes.

Another object of the present invention is to provide a firearm with an identification safety system that is simple and easy to use.

A still further object of the present invention is to provide a firearm with an identification safety system that is economical in cost to manufacture.

Additional objects of the present invention will appear as the description proceeds.

A firearm with an identification safety system for preventing use by an unauthorized user is disclosed by the present invention. The firearm includes a barrel for discharging the firearm therethrough, a butt section connected to the barrel, a trigger connected between the barrel and butt section for initiating discharge of the firearm and a safety switch operable between a first position preventing discharge of the firearm and a second position allowing discharge of the firearm. A pressure sensor is positioned in the butt section for sensing grasping of the butt section by a palm of a user and a scanning sensor is connected for scanning a palm print of the palm of the user and generating a data signal representative of the scanned palm print upon sensing grasping of the butt section by the pressure sensor. A memory unit stores data signals representative of palm prints of authorized users and a microprocessor is connected to both the scanning sensor and the memory unit for receiving the data signal from the scanning sensor and comparing the received data signal to the data signals stored in the memory unit. The microprocessor controls the safety switch to operate in the first position upon determining the received data signal does not match any of the data signals stored in the memory unit and controls the safety switch to operate in the second position upon determining the received data signal matches one of the data signals stored in the memory unit.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
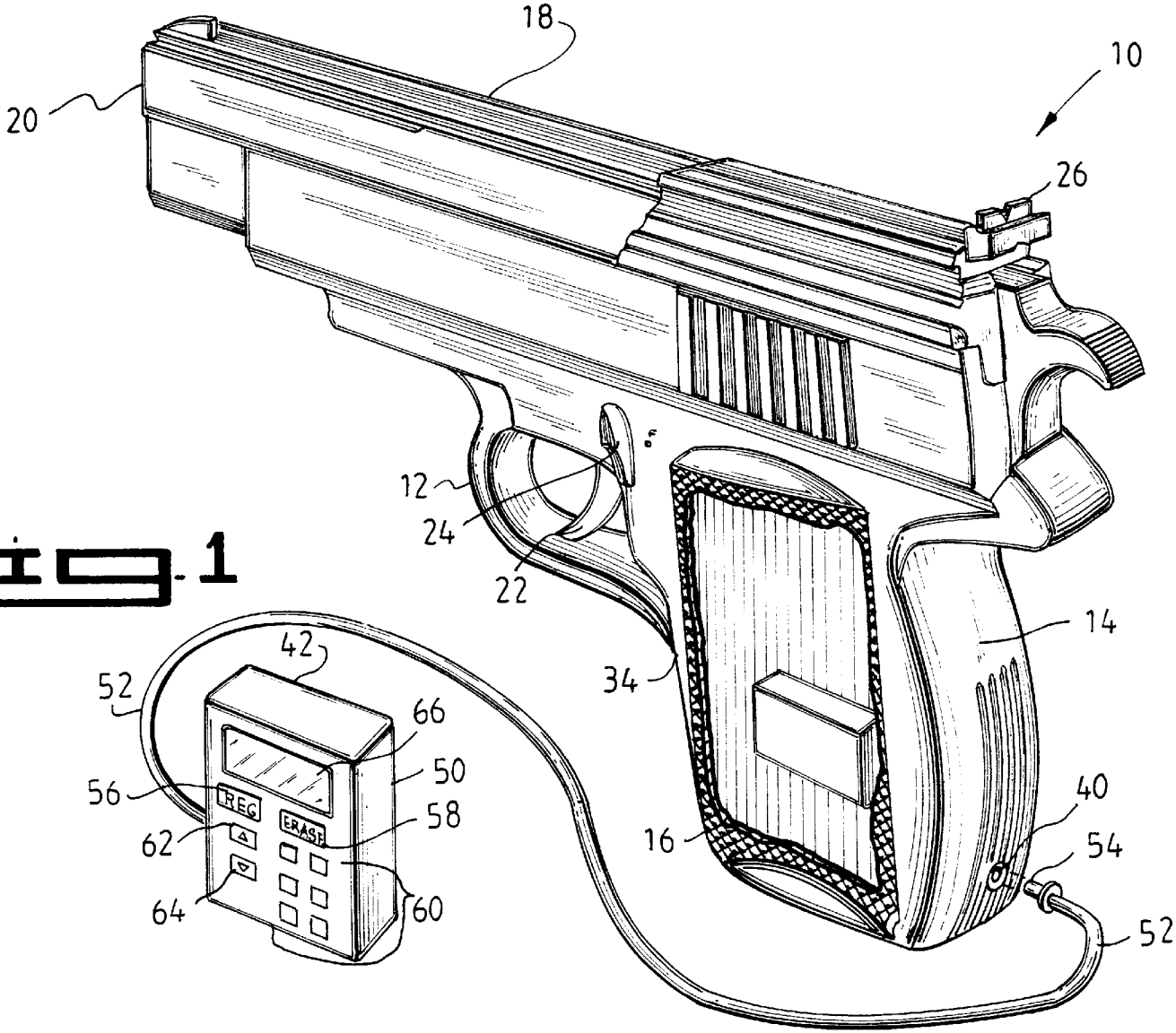
FIG. 1 is a top perspective view of the firearm with an identification safety system of the present invention.

Turning now descriptively to the drawings, in which similar reference characters denote similar elements throughout the several views, the Figures illustrate the firearm with an identification safety system of the present invention. With regard to the reference numerals used, the following numbering is used throughout the various drawing figures.

10 firearm with an identification safety system of the present invention
12 frame
14 butt section
16 hand grips
18 barrel
20 muzzle
22 trigger
24 safety
26 sight
28 thumb of user
30 forefinger of user
32 palm of user
34 rigid frame
36 pressure sensitive fiber optics
38 scanning fiber optics
40 input port for programming memory unit
42 programming device
44 sensors
46 memory unit
48 microprocessor/controller
50 base unit of programming device
52 connection wire
54 adapter
56 program key
58 erase key
60 alpha numerical keypad
62 up scroll key
64 down scroll key
66 visual display

DETAILED DESCRIPTION OF THE PREFERRED EMBODIMENT

Turning now descriptively to the drawings, in which similar reference characters denote similar elements throughout the several views, FIGS. 1 through 5 illustrate the firearm with an identification safety system of the present invention indicated generally by the numeral 10.

The firearm with an identification safety system 10 of the present invention is shown in FIG. 1 and includes a frame 12 providing a butt section 14 including hand grips 16 and a barrel 18 having a muzzle 20. Also included is a trigger 22 and a safety pin 24. A top the barrel 18 is a sight 26 for use in aiming the firearm 10. The firearm 10 depicted in the figures is a semiautomatic gun. However, the present invention may be implemented in any type of gun, either bullet or laser type. The present invention is thus not meant to be limited to the type of firearm depicted in the figures.

Figure 2:
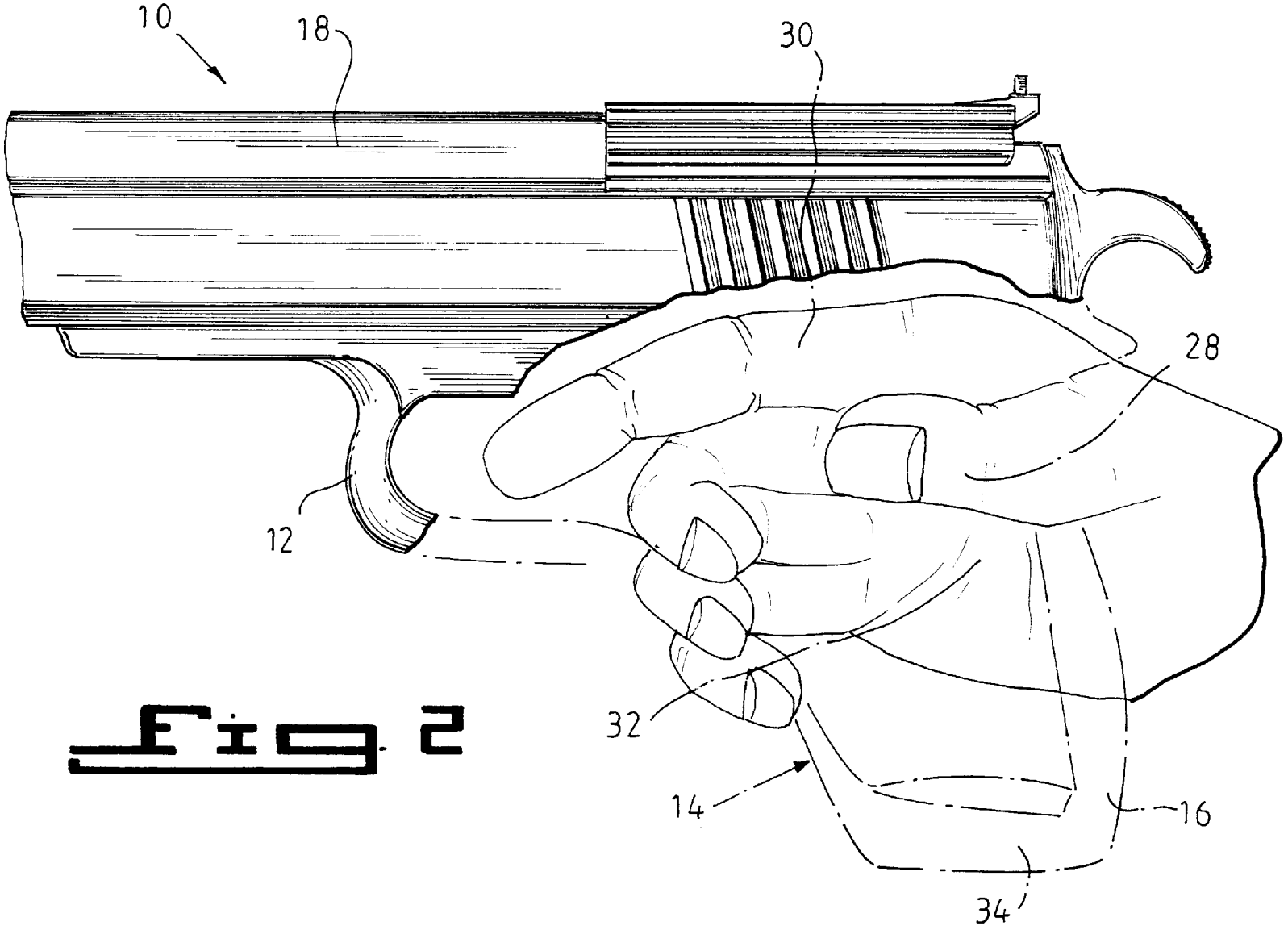
FIG. 2 is a side view of the firearm with an identification safety system of the present invention in the hand of a user, the butt being shown in dot-dashed lines.
Figure 3:
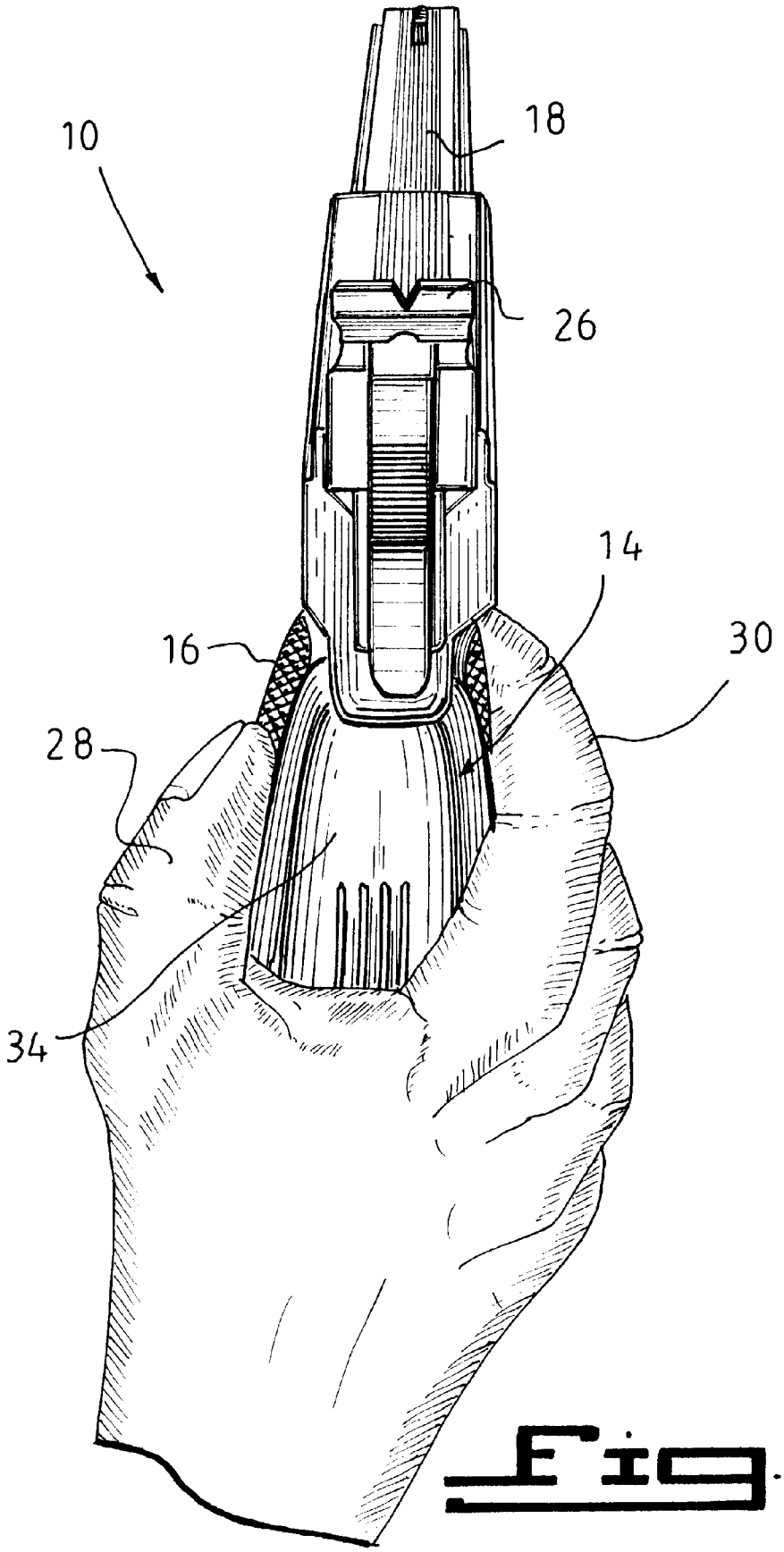
FIG. 3 is a back side perspective view of the firearm with an identification safety system of the present invention shown in FIG. 2, in the hand of a user.

The correct way to hold a firearm such as the firearm with an identification safety system 10 of the present invention is illustrated in FIGS. 2 and 3. The butt 14 is positioned between the thumb 28 and forefinger 30 of the user. The remaining three fingers grip the hand grip 16 of the butt 14 and the forefinger 30 bends around and contacts the trigger 22. The palm 32 of the user is pressed against the rigid frame 34 of the butt 14 holding the firearm 10 at the correct firing angle.

In order to discharge a conventional firearm, the safety pin 24 must be placed in the released/firing position before the firearm may be fired. When the safety is in the engaged position the firearm may not be discharged. There is no additional means for restricting discharge of the firearm or regulating who is authorized to use the firearm. Upon movement of the safety pin 24 into the firing or released position the firearm can be discharged. This is a mechanical switch which can be operated by any person in contact with the firearm regardless of age, ability or authorization to use the firearm.

Figure 5:
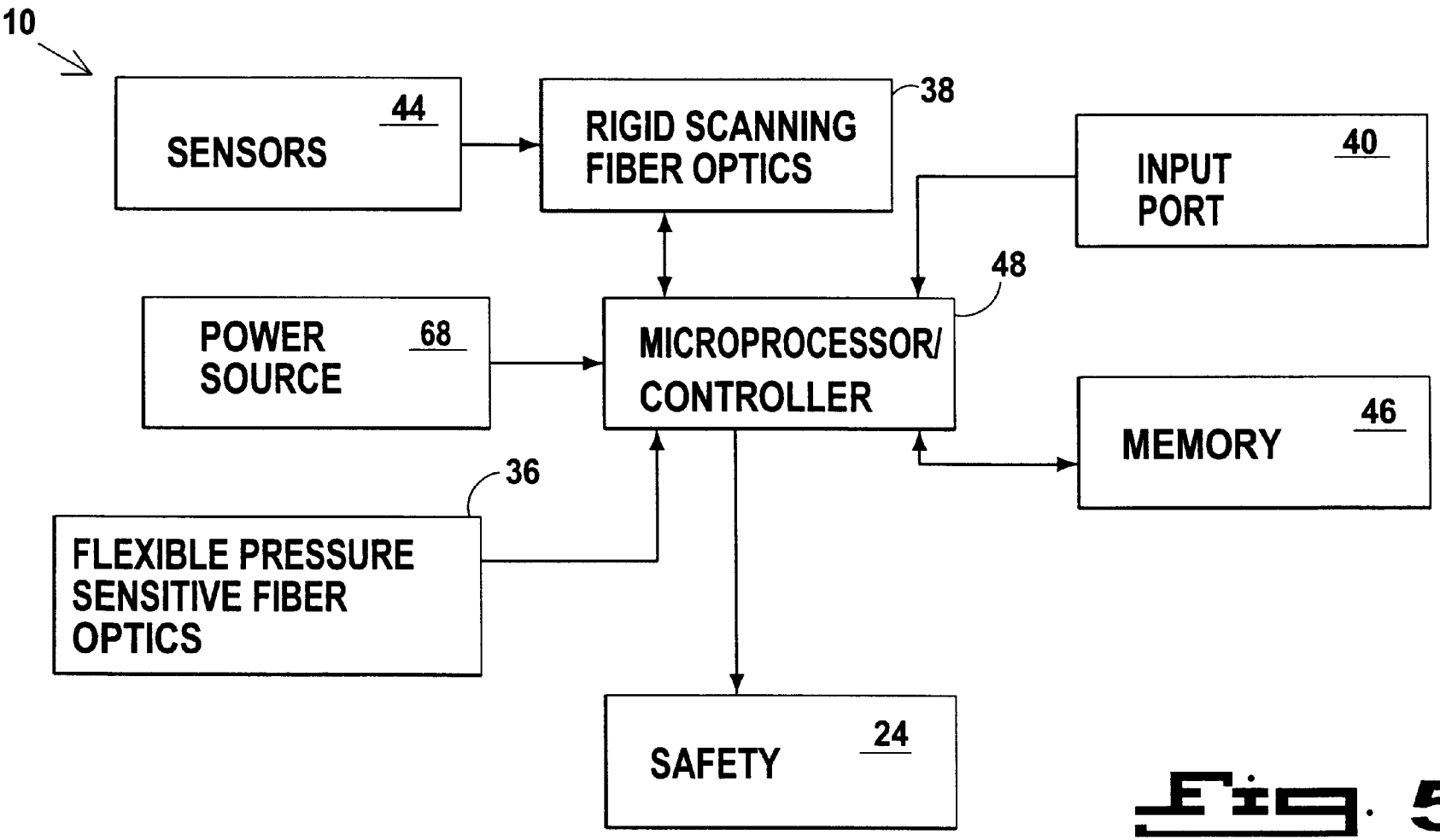
FIG. 5 is a schematic block diagram of the firearm with an identification safety system of the present invention.

The firearm with an identification safety system 10 of the present invention includes an additional safeguard for preventing unauthorized users from discharging the firearm 10. The additional safeguard is positioned within the butt 14 of the firearm 10. The butt 14 of the firearm includes a rigid frame 34 forming a housing for a plurality of pressure sensitive fiber optics 36 and a plurality of scanning fiber optics 38 as shown in FIGS. 1 and 5. The rigid frame 34 is preferably made of carbon graphite however any other suitable material such as steel, hard plastic or any material which will provide the necessary structural integrity may be used. On an outer surface of the rigid frame 34 is an input port 40 for connection of a programming device 42 used to control input of the palm prints of authorized users for storage and deletion of palm prints of unauthorized users from storage.

The plurality of pressure sensitive fiber optics 36 are preferably flexible in structure and positioned within the rigid frame 34 so as to be able to detect when the butt 14 of the firearm 10 has been gripped by a user. The plurality of scanning fiber optics 38 are grouped to form a plurality of cells which are rigid in structure and randomly positioned about the butt 14 of the firearm 10. Each cell comprises hundreds of scanning fiber optics bundled together, each of the scanning fiber optics including a sensor 44. The cells are strategically placed about the butt 14 of the firearm 10 whereby they may scan the palm area of the user.

A schematic block diagram of the firearm with an identification safety system 10 of the present invention is illustrated in FIG. 5. As can be seen from this diagram the input port 40 is connected to a memory unit 46 via a microprocessor/controller 48. Stored within the memory unit 46 is a software algorithm for use by the microprocessor/controller 48 in reading the scanned palm print of a user of the firearm 10 and comparing the palm print to stored prints of authorized users. The microprocessor/controller 48 is also connected to the pressure sensitive fiber optics 36, the scanning optics 38 and to the safety 24. The pressure sensitive fiber optics 36 transmit a control signal to the microprocessor/controller 48 when it is sensed that the butt 14 of the firearm 10 has been gripped by a user. The microprocessor/controller 48 is preferably an optical processor able to process and recognize the scanned palm print at an extremely high speed and thus speedily enable the weapon to fire. The microprocessor/controller 48 then signals the scanning optics 38 and sensors 44 to scan the palm print of the hand gripping the butt 14 in accordance with the software algorithm stored in the memory unit 46. The scanned palm print is then transmitted to the microprocessor/controller 48 in which it is compared to the palm prints of authorized users. If the palm print matches that of an authorized user then the safety 24 is controlled by the microprocessor/controller 48 to be released and the firearm may be fired. The microprocessor/controller 48 includes an internal clock which keeps track of the current date and time. Each time a control signal indicative of a palm print of an authorized user is received, the microprocessor/controller 48 stores the date, time and user of the firearm in the memory unit 46 for later retrieval as a log indicating use of the firearm. This log is helpful for ballistic purposes to determine when the firearm was fired and who fired it. If the palm print does not match that of an authorized user then the safety 24 is held by the microprocessor/controller 48 in its secured engaged position preventing the firearm from being fired.

In scanning the palm print of the person gripping the butt 14 of the firearm 10 each cell of scanning fiber optics 38 will scan a particular area of the palm print and generate a data signal therefrom. This data signal will then be digitized to be represented by a numerical value. Each cell thus generates a digitized signal. These digitized signals will be transmitted to the microprocessor/controller 48 for comparison with signals representative of palm prints of authorized users. Upon receipt of the digitized signals the microprocessor/controller 48 will retrieve the signals representative of palm prints of authorized users stored in the memory unit 46 and compare the generated signals with the stored signals. If a match is found it is determined that the person gripping the butt 14 of the firearm 10 is an authorized user and the safety is released allowing the firearm to be discharged. If a match is not found it is determined that the person gripping the butt 14 of the firearm 10 is not an authorized user and the firearm is prevented from being discharged.

Figure 4:
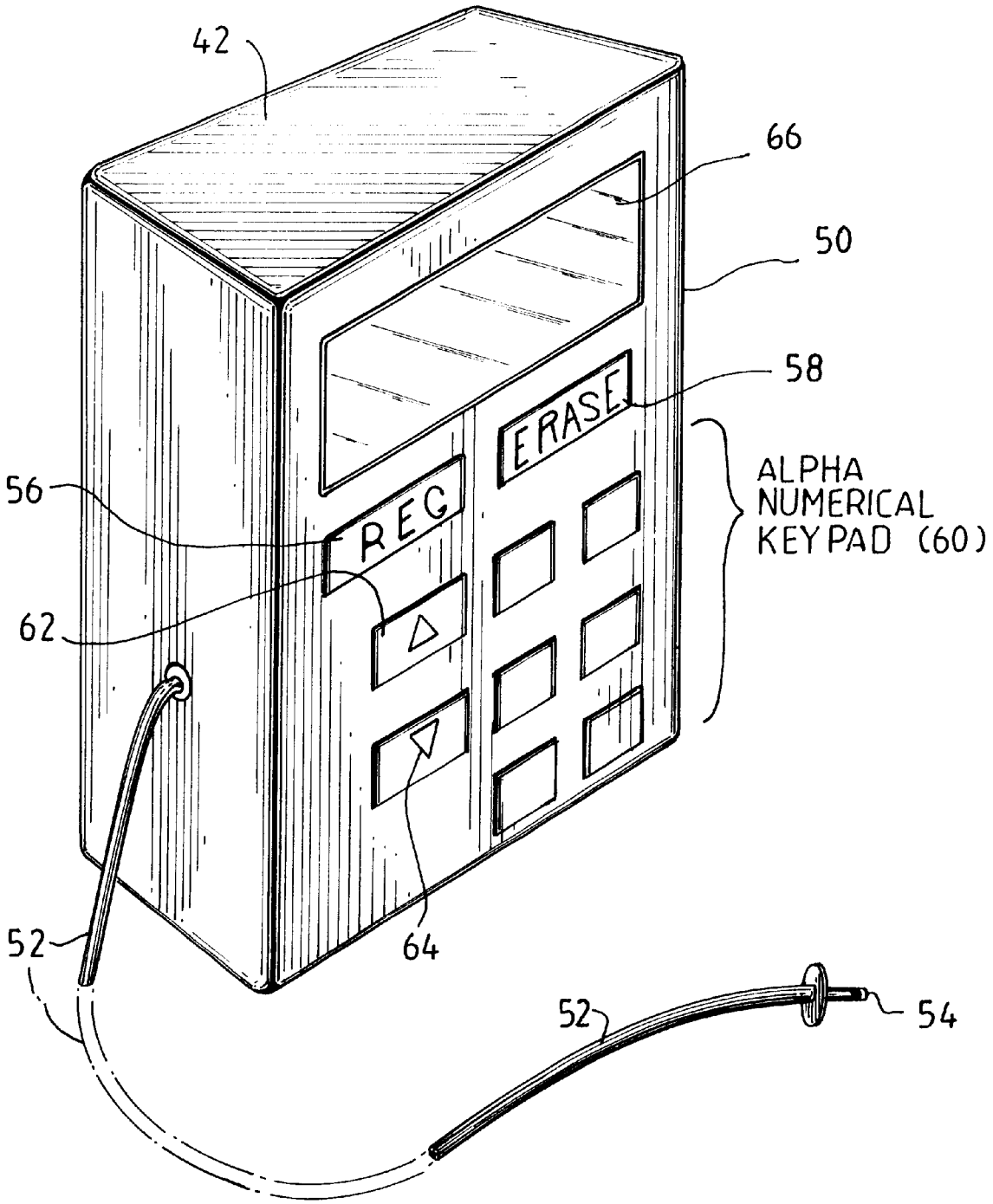
FIG. 4 is a top perspective view of the programming device for use with the firearm with an identification safety system of the present invention.

FIG. 4 illustrates the programming device 42 used to program the memory unit 46 of the firearm with an identification safety system 10. The programming device 42 includes a base unit 50 and a connecting wire 52 including an adapter 54 for connection to the input port 40 of the firearm 10. The base unit includes a program key 56 for initiating storage of a palm print of an authorized user into the memory unit 46 and an erase key 58 for eliminating a palm print of a previously authorized user from the memory unit 46. An alphanumerical keypad 60 for attaching an identification tag to a palm print stored in the memory unit 46 is present on the base unit along with an up scroll key 62 and a down scroll key 64. The base unit 50 also includes a visual display 66 for displaying the identification tags of the palm prints stored in the memory unit 46. The up and down scroll keys 62 and 64 allow a user to scroll through the identification tags displayed on the visual display 66.

Figure 6A:
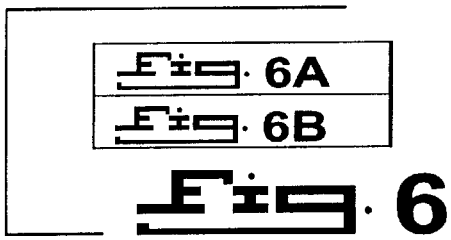
FIG. 6 is a flow chart illustrating the operating process of the firearm with an identification safety system of the present invention.
Figure 6A:
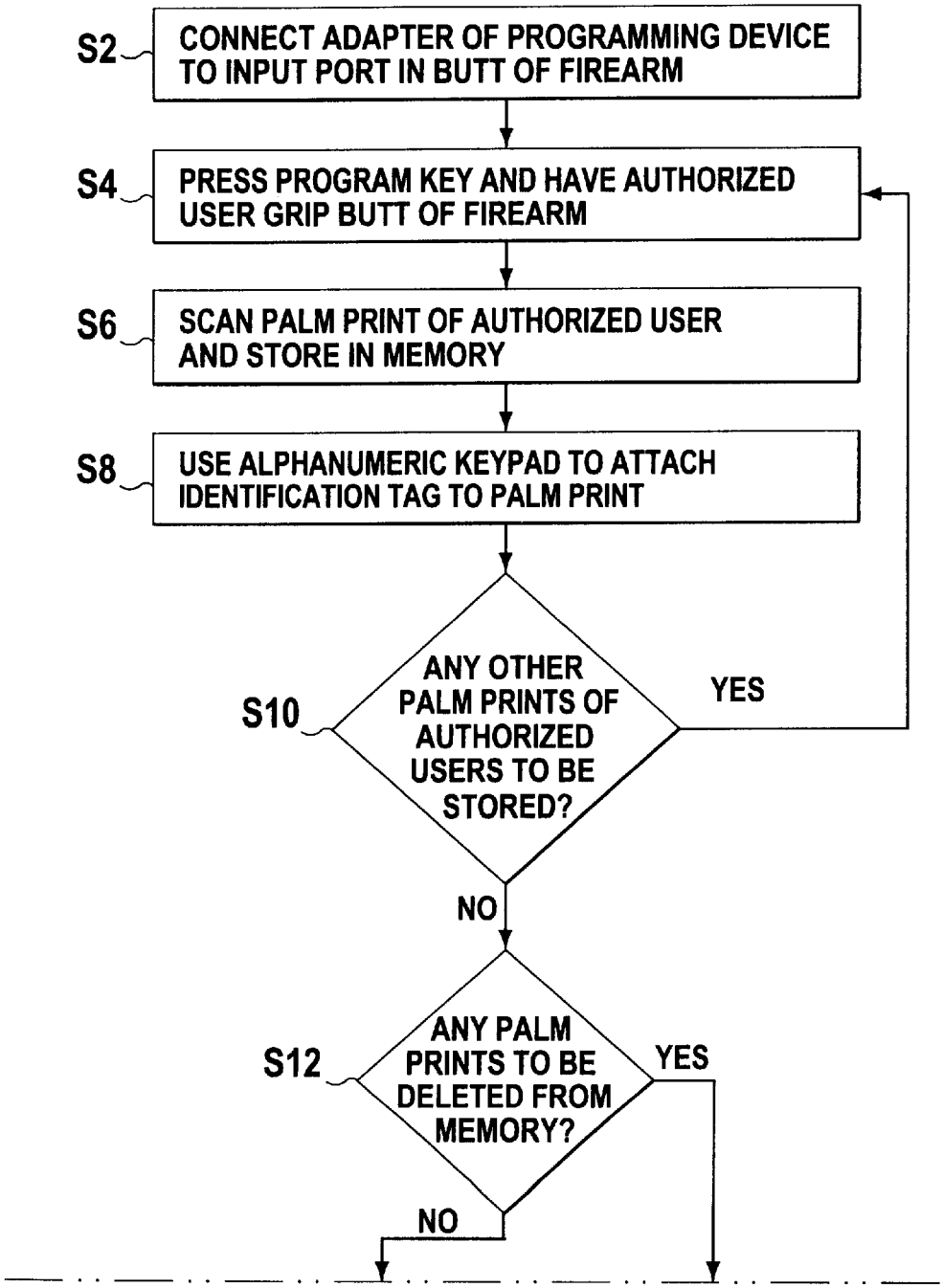
Figure 6B:
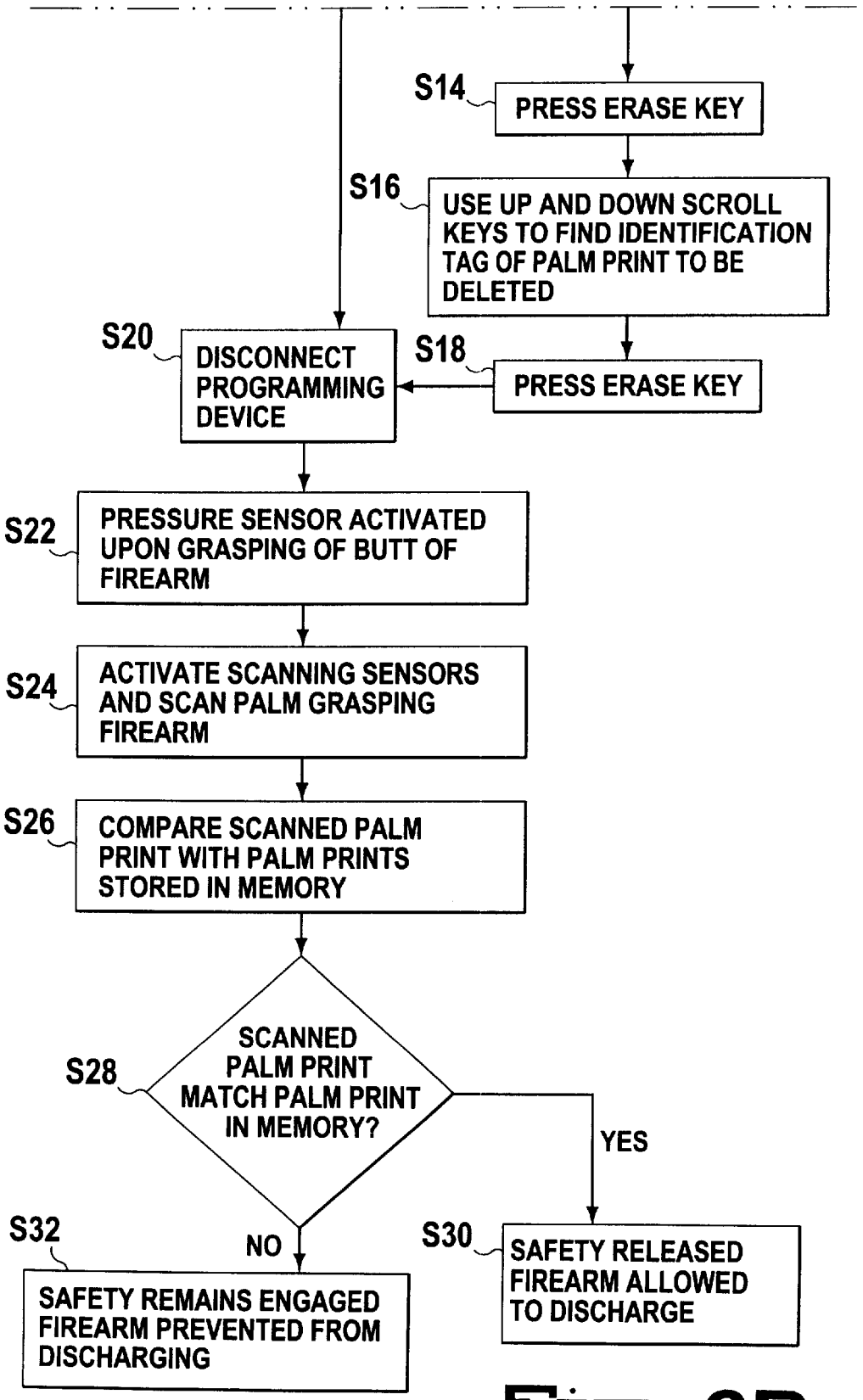

The operation of the firearm with an identification safety system of 10 will now be described with reference to the figures and specifically to FIG. 6. In operation, the firearm with an identification safety system 10 must first be programmed by storing palm prints of authorized users in the memory unit 46. In order to program the memory unit 46 the adapter 54 of the programming device 42 is connected to the output port 40 in the butt 14 of the firearm 10 as described in step S2. The program key 56 is then pressed and the authorized user will grip the butt 14 of the firearm 10 as stated in step S4. Gripping of the butt 14 of the firearm 10 will activate the pressure sensors 34 and in turn activate the scanning fiber optics 36 to scan the palm print of the authorized user and store it in the memory unit 46 as discussed in step S6. The alphanumeric keypad 60 is then used to attach an identification tag to the scanned palm print in the memory unit 46 for identifying the palm print as described in step S8. At step S10, if palm prints of any other authorized users are to be stored in memory then the process is repeated starting with step S4 otherwise the process continues with S12. In step S12 it is determined if any palm prints must be deleted from the memory unit 46. If there are palm prints to be deleted then the erase key 58 is pressed in step S14. In step S16 the up and down scroll keys 62 and 64 respectively are used to scroll through the identification tags stored in the memory unit 46. The identification tags are displayed on the visual display 66. Once the identification tag to be deleted is found, the erase key 58 is pressed again in step S18 deleting the palm print from memory and removing the user from the list of authorized users. The programming device 42 is then disconnected from the firearm 10 by removing the adapter 54 from the input port 40 in step S20.

The firearm is now ready for use. Upon grasping of the butt 14 of the firearm 10 by a user the pressure sensors 36 are activated as described in step S22. In step S24 the scanning sensors 38 are activated to scan the palm of the person using the firearm 10 to thereby generate a digitized signal representative of the scanned palm. The digitized signal is then compared to the signals representing palm prints of authorized users stored in memory as stated in step S26. A determination as to whether the scanned palm print matches a palm print of an authorized user stored in the memory unit 46 is made in step S28. If it is determined in step S28 that the scanned palm print matches a palm print of an authorized user, the safety is released allowing the firearm to be discharged in step S30. If it is determined in step S28 that the scanned palm print does not match a palm print of an authorized user, the safety 24 is not released and the firearm is prevented from being discharged as stated in step S32.

From the above description it can be seen that the firearm with an identification safety system of the present invention is able to overcome the shortcomings of prior art devices by providing a firearm with an identification safety system which is able to identify authorized users of the firearm, prevents use of the firearm by an unauthorized user and is able to record the time, date and user whenever the weapon is used for retrieval at a later time and used for ballistic purposes. The firearm with an identification safety system includes a pressure sensor for determining when the firearm is handled and initiate an identification process upon determining the firearm is being handled and a plurality of scanners for scanning the palm of a user handling the firearm for comparison against a database of previously scanned palm prints to determine if the user is authorized. Furthermore, the firearm with an identification safety system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A firearm with an identification safety system for preventing use of said firearm by an unauthorized user, said firearm with an identification safety system comprising:

a) a barrel for discharging said firearm therethrough;

b) a butt section connected to said barrel;

c) a trigger-connected between said barrel and said butt section for inititiating discharge of said firearm;

d) a safety switch operable between a first position preventing discharge of said firearm and a second position allowing discharge of said firearm;

e) a pressure sensor for sensing grasping of said butt section by a palm of a user;

f) a scanning sensor for scanning a palm print of the palm of the user and generating a data signal representative of said scanned palm print upon sensing grasping of said butt section by said pressure sensor;

g) a memory unit for storing a a plurality of data signals representative of plurality of palm prints of authorized users; and h) a microprocessor connected to both said scanning sensor and said memory unit for receiving said data signal from said scanning sensor and comparing said received data signal to said data signals stored in said memory unit, wherein said microprocessor controls said safety switch to operate in said first position upon determining said received data signal does not match a data signal stored in said memory unit and controls safety switch to operate in said second position upon determining said received data signal matches one of said data signals stored in said memory unit;

i) an input port connected to said microprocessor;

j) means connectable to said input port for programming said microprocessor to add or withdraw authorized users to or from said memory unit comprising a program key for initiating storage of a data signal into said memory unit when a user to be authorized grips said butt, an alphanumeric keypad for attaching identification tags to data signals stored in said memory unit, a visual display for viewing said identification tags stored in said memory unit, scroll keys for scrolling through said identification tags displayed on said visual display, and an erase key for deleting an authorized user from said memory unit when an identification tag for said authorized user to be deleted is scrolled to on said visual display; and k) said microprocessor storing a date, time and user identification in said memory unit upon determining that received data from a user handling said firearm matches one of said plurality of data signals for authorized users stored in said memory unit.

2. A firearm with an identification safety system as defined in claim 1, wherein said scanning sensor includes a plurality of individual fiber optics, each fiber optic including a scanner and being randomly positioned about said butt section.

3. A firearm with an identification safety system as defined in claim 2, wherein said plurality of individual fiber optics are bundled together to form a plurality of fiber optic groups.

4. A firearm with an identification safety system as defined in claim 3, wherein said plurality of fiber optic groups include means for digitizing said generated data signal.

5. A firearm with an identification safety system as defined in claim 1, wherein said butt section includes a rigid frame.

6. A firearm with an identification safety system as defined in claim 5, wherein said rigid frame is made of at least one of carbon graphite, steel, hard plastic or any combination thereof.

7. A firearm with an identification safety system as defined in claim 1, wherein said microprocessor is an optical processor.

* * * * *